US005829634A

United States Patent [19]

Gloger et al.

[11] Patent Number: 5,829,634

[45] Date of Patent: Nov. 3, 1998

[54] METHOD OF DISCHARGING A FROZEN BLOOD PRODUCT

[75] Inventors: Rudolf Gloger; Peter Neuper, both of Vienna, Austria

[73] Assignee: Immuno Aktiengesellschaft, Vienna, Austria

[21] Appl. No.: 837,974

[22] Filed: Apr. 14, 1997

[30] Foreign Application Priority Data

Jun. 26, 1996 [AU] Australia ..... GM 388/96

[51] Int. Cl.[6] ..... B65D 35/28; B67D 5/62

[52] U.S. Cl. ..... 222/1; 222/102; 222/146.5; 604/408

[58] Field of Search ..... 222/102, 146.5, 222/1; 604/408

[56] References Cited

U.S. PATENT DOCUMENTS

| | | | |
|---|---|---|---|
| 3,604,418 | 9/1971 | Jones | 222/102 |
| 4,253,458 | 3/1981 | Bacehowski et al. | 128/272 |
| 4,266,751 | 5/1981 | Akhavi | 222/102 |
| 5,135,646 | 8/1992 | Tanokura et al. | 222/95 |

FOREIGN PATENT DOCUMENTS

| | | |
|---|---|---|
| 0 318 924 | 6/1989 | European Pat. Off. . |
| 42 30 774 A1 | 3/1994 | Germany . |

*Primary Examiner*—Andres Kashnikow
*Assistant Examiner*—Keats Quinalty
*Attorney, Agent, or Firm*—Foley & Lardner

[57] ABSTRACT

A method and an apparatus for discharging a frozen blood product from a container, wherein, for automating purposes, the surface layer of the frozen blood product on the container wall is slightly thawed by heating from outside, whereby a liquid film is formed between the ice core and the container wall, and the container is opened to form a discharge opening on one side, whereupon the ice core is squeezed out of the container by aid of pressing elements, under application of pressure forces acting on the container and on the ice core, starting from the opposite side of the discharge opening.

48 Claims, 5 Drawing Sheets

METHOD OF DISCHARGING A FROZEN BLOOD PRODUCT

The invention relates to a method of discharging a frozen blood product from a container, a discharge opening in the container being opened on one side, and the frozen blood product being pressed out of the container through the discharge opening from the side opposite the discharge opening.

Furthermore, the invention relates to an apparatus for discharging a frozen blood product from a container in which a discharge opening is provided at one side thereof, including pressing elements for squeezing out the frozen blood product from the container through the discharge opening thereof.

It is common to discharge frozen blood products, such as human blood plasma or cryoprecipitate, from their bottle-type or bag-type containers in that the containers are separated manually from the frozen blood product after having been opened. This procedure not only is time-consuming and expensive, but also includes the risk of contaminating the blood product.

Then in U.S. Pat. No. 4,253,458 A, a mechanical squeezing out of frozen blood plasma from a container by aid of rolls has been suggested. To squeeze out the frozen blood product in a gentle manner, a special shape of the container (and thus of the frozen core) has been provided, i.e. a shape widening wedge-like from the end opposite the discharge opening towards the discharge opening. Such special containers do, however, increase costs and thus have not been accepted in practice.

On the other hand, from DE 42 30 774 A it has already been known to use a warmed fluid for the thawing of deep-frozen blood products; in that case, the entire product is thawed. Afterwards it is squeezed out of the container in the liquid state. However, such individual thawing requires very much time and special apparatus are required for simultaneously thawing several containers, if needed, which further adds to the costs of this technique.

Similarly, EP 318 924 A shows an arrangement for thawing a deep-frozen product and maintaining it at a given temperature, including bags containing a medium at a given temperature to be outwardly applied to the deep-frozen product, one of the bags being oscillatingly moved so as to increase the warming-up speed. It is not suggested to squeeze out an ice core, but the product is thawed completely and maintained at the given temperature.

It is an object of the invention to reduce the manipulations required with such containers when removing a frozen blood product.

In particular, it is an object of the invention to provide for a gentle, yet nevertheless at least largely automatic, problem-free discharge of the frozen core from the container.

Furthermore, it is an object of the invention to provide such a procedure and apparatus, in which contact of the blood product with the personnel is largely avoided.

Furthermore, according to still another object of the invention, simple disposal of the empty plasma container is to be ensured.

According to the invention, the surface layer of the frozen blood product in contact with the container wall is slightly thawed by external warming, and thus a liquid film is formed between the frozen core and the container wall; afterwards the frozen core is expelled or squeezed out of the container by the application of pressure forces acting on the container and on the frozen core starting from the side opposite of the discharge opening.

Likewise, according to the invention the apparatus of the initially defined kind comprises a warming device for externally thawing the surface layer of the blood product at the container wall.

By these measures, the objectives mentioned before can be met in an advantageous manner, and a gentle, automated, simple and rapid discharge of the frozen core from the container can be achieved, wherein the sterility of the blood product is maintained and contact with persons may be avoided. The liquid film which preferably is created before the discharge opening is made, yet optionally also while the same is being made or also thereafter, ensures sliding of the frozen core along the container wall so that removal of the frozen core is enabled without any problems by applying pressure forces in the manner indicated, whereby, as a consequence of the sliding film, comparatively slight pressure forces will suffice and furthermore the container shape is not critical so that any conventional bag or bottle-shaped container can be used. The liquid film may simply already be obtained in that the container's outside is washed or flushed with warm washing liquid prior to discharge of the frozen core, optionally it is also dried afterwards, the liquid film resulting from slight external thawing. If the time between this cleaning procedure and the discharge procedure is rather short, the liquid film will remain long enough that the frozen core can be squeezed out. If the container with the blood product must be cleaned already relatively long before the frozen core is discharged, or is not cleaned, the container need to be warmed accordingly by external means just before the frozen core is discharged. Warming may be effected in various ways, for example with heating elements, warm water, washing solution or warm air; it would even be conceivable to let the liquid film form only during application of the pressure forces, e.g. by pressing adequately heated pressing elements long enough against the container to form the liquid film and the frozen core can be expelled.

As mentioned before, it is suitable to generate the liquid film in the course of a preceding cleaning of the container, and thus it is particularly advantageous if heating is effected by externally flushing the container with a warmed medium, in particular warm water and/or warm air. It has proven particularly suitable if flushing is effected with a medium maintained at approximately 10° C. to 70° C., preferably 10° C. to 40° C., in particular 25° C. to 40° C.

On the other hand, heating may also be directly effected in the course of discharging the plasma core, namely immediately prior to, simply by irradiation, e.g. by means of infrared radiation, or by another suitable source of heating.

Advantageously, the container is simply cut open at one end to form the discharge opening, which may be done automatically, by aid of a cutting tool, e.g. with a blade. The cutting tool is activated at the required point of time and driven to cut the container open. If the containers are rather stiff, bottle-shaped, the discharge opening may be made at the bottom side by cutting open almost the entire periphery of the bottle-shaped container so that the cut-off bottom part stays connected with the container via a remaining portion and may be pushed away about this portion. In case of a bag-type container which may be folded flat in the empty state, it has, however, proven to be sufficient with respect to discharging, if the bag-shaped container is cut open in peripheral direction over only little more than approximately half the periphery.

To discharge the frozen core from the container by squeezing it is then particularly advantageous if the pressure forces are distributed over the longitudinal extension of the container in such a fashion that the pressure decreases from the opposite side of the discharge opening towards the discharge opening. In this manner it is ensured that starting from the side opposite the discharge opening, the frozen core is detached from the container and is gradually pressed out of the latter. This desired distribution of pressure forces may be particularly simply obtained if the pressure forces are applied by aid of pressing elements inclinedly applied lengthwise to the container over the longitudinal extension thereof. On the other hand it would, as such, also be possible to apply the pressure forces by aid of pressing elements subdivided in compartments over the longitudinal extension of the container, the pressing element compartments successively being admitted with—optionally also different—pressures. Accordingly, in an advantageous variant of the method according to the invention, the pressure forces are applied by pressing elements which exercise their force gradually distributed over the longitudinal extension of the container, starting from the side opposite of the discharge opening.

Discharge of the frozen core may, however, also be performed by the simple pressure of a piston or plunger on the container or on the frozen core, respectively. According to a preferred embodiment, the container is guided between at least two roll elements which remove the frozen core from the container by a counter-movement and by application of tensile and pressure forces on the frozen core.

The roll elements preferably are provided with a rough surface, e.g. a corrugated or fluted surface, so that the bag, after having been contacted, is gripped by the roll elements and pulled through. As the material, preferably special steel or a like high-quality synthetic material is to be used. Preferably, cylindrical rolls having a circular cross-section are chosen.

As has already been mentioned, it is suitable if the container is cleaned by externally flushing it with a cleaning medium before the blood product is discharged in the form of an ice core. The cleaning provides for the further reduction of the risk of a possible contamination of plasma at the discharge.

For a gentle application of pressure, a configuration of the apparatus has proven suitable which is characterized by pressing elements mounted to a trestle, associated to a receiving space for the container containing the blood product, which pressing elements at least partially are designed to be rigid or are provided with a rigid carrier part and are engageable by pressing means on a container arranged in the receiving space under application of pressure forces, starting from the side opposite the discharge opening.

An advantageous embodiment of the apparatus according to the invention then is characterized in that the pressing elements, optionally inclusive of the carrier parts, are exchangeably mounted to the trestle so as to be adaptable to different container cross-sections.

To achieve the previously mentioned distribution of pressure forces which varies over the longitudinal extension of the container, it is suitable if the pressing elements, optionally including the carrier parts, generally extend over the longitudinal extension of the container and may be pressed against the container in an inclined position.

An embodiment which is particularly simple to handle and furthermore is very stable can be obtained if two half-shells arranged according to a conical surface are provided as the carrier parts. For enclosing the containers, it is furthermore suitable if the half-shells are articulately interconnected at one of their longitudinal sides, whereas a closing and tensioning mechanism is provided at the other longitudinal sides for a generally radial exertion of pressure force on the container. There, for a uniform pressure distribution about the periphery of the container it is also advantageous if each half-shell-type carrier part carries a plurality of elongate, flexible pressing elements at its inner side.

For a simple adaptation to various container cross-sections, particularly in case of bag-type containers which may be relatively flat to nearly circular cylindrical in the frozen state of the blood product contained therein, it is also suitable if the carrier parts are generally ledge-shaped, optionally having an arcuate profile, and articulately interconnected like a link chain, a closing and tensioning mechanism being provided at one longitudinal side for a generally radial exertion of pressure forces on the container. Suitably, it is also provided for each ledge-shaped carrier part to carry a flexible pressing element on its inner side.

The pressing elements may, on the one hand, be simply formed by rubber-elastic, in particular elongate, pressing pads, which, by aid of the carrier parts, may be pressed against the container from which the frozen product is to be discharged. On the other hand, for a gentle, reliable discharge of the frozen core it has proven particularly advantageous if the pressing elements are formed by pressing pads, in particular flexible hose-type pressing pads, to which a pressure medium may be supplied. To achieve a gradual pressure force exertion over the longitudinal extension of the container, starting at the side opposite the discharge opening, it is also suitable if the pressing elements are designed in the form of peripherally extending annular pressing pads, or if the pressing pads are distributed over the longitudinal extension of the container, and are separately supplied with pressure medium, respectively.

It is advantageous if a laterally or downwardly removable, e.g. plate-shaped, support for the containers is mounted on the trestle below the receiving space between the pressing elmements. The support serves for temporarily supporting the respective container until the latter has been clamped tightly by the pressing elements at the discharging procedure; at this time, the support is moved away, e.g. automatically, such as pivoted away laterally or downwardly, so as to clear the path for the frozen core to be discharged.

For the automatic cutting open of the respective container for making the discharge opening, it is furthermore advantageous if below the pressing elements, a cutting tool, in particular a blade, is arranged in the trestle so as to be movable about at least somewhat more than half the periphery of the container.

As mentioned before, it is sought to allow the entire discharge procedure to occur automatically, yet a manual secondary processing may be possible, i.e. if, in the course of the automatic procedure, the frozen core has not been pressed out of the container or has been pressed out only in part. In this case appropriate detection must be ensured at the apparatus, e.g. by means of a photoelectric switch for sensing the pressed out frozen core, or by aid of an optic sensor or a weighing device for detecting the "empty" container.

Advantageously it is also provided for at least those parts of the apparatus which come into contact with the container to be cleaned after each discharge procedure, and in this connection it has proven particularly advantageous if the trestle with the pressing elements is mounted in an immersion tub capable of being flooded for cleaning purposes.

For a particularly rapid automated procedure when discharging the frozen core, in which also an automatic supply of containers in form of a conventional conveying technique may be provided, it is particularly advantageous if the trestle with the pressing elements is mounted to a revolver rotatable about a vertical axis and comprising a container supply station, a frozen core squeeze out station as well as a container disposal station. Thus, several trestles with pressing elements are provided in accordance with the number of stations of the revolver, which pass through the individual stations so that containers with the frozen blood products are simultaneously accepted in the individual stations, frozen cores are pressed out and empty containers are disposed of.

By forming the liquid film, according to the inventive slight thawing of the plasma product, simple pressing elements can satisfactorily be used also with the most varying container designs, and accordingly it is suitable if the pressing elements are formed by at least two roll elements which are rotatable in opposite directions and have generally parallel axes of rotation, the end opposite the discharge end of the container being gripped between the rolls and, while pressing out the blood product, is moved through therebetween in the empty state. There, it is further advantageous if a chute is arranged behind the roll elements for moving away the empty containers.

As already mentioned, various devices may be used as the warming means, wherein it is suitable, particularly with a view to multiple usage, if devices to be used for cleaning the containers simultaneously are used for slightly thawing the surface of the plasma product. Accordingly, it is particularly suitable if a flushing means for externally flushing the containers is provided as the warming means. There, the flushing means may, e.g., be formed with spraying nozzles.

Moreover, if warming during flushing or cleaning, respectively, is not sufficient for a slight thawing, or instead of providing the flushing means, it is also advantageous if infrared radiators are provided as the warming means. Such IR radiators (or comparable warming elements) may, e.g., be provided in the region where the containers are supplied to the pressing elements, on the trestle of the pressing elements and/or on the carrier parts.

The invention will now be explained in more detail by way of preferred exemplary embodiments to which, however, it shall not be limited, and by reference to the drawings. In detail, in the drawings FIG. 1 shows a schematic view, partially sectioned according to line I—I of FIG. 2, of an apparatus for discharging frozen blood plasma from a bottle-shaped container;

FIG. 2 shows a cross-section through this apparatus according to line II—II of FIG. 1;

FIGS. 3, 4 and 5 quite schematically show cross-sectional representations of other embodiments of such an apparatus, generally similar to the cross-sectional representation according to FIG. 2, for adaptation to different container cross-sections;

Figure 10:
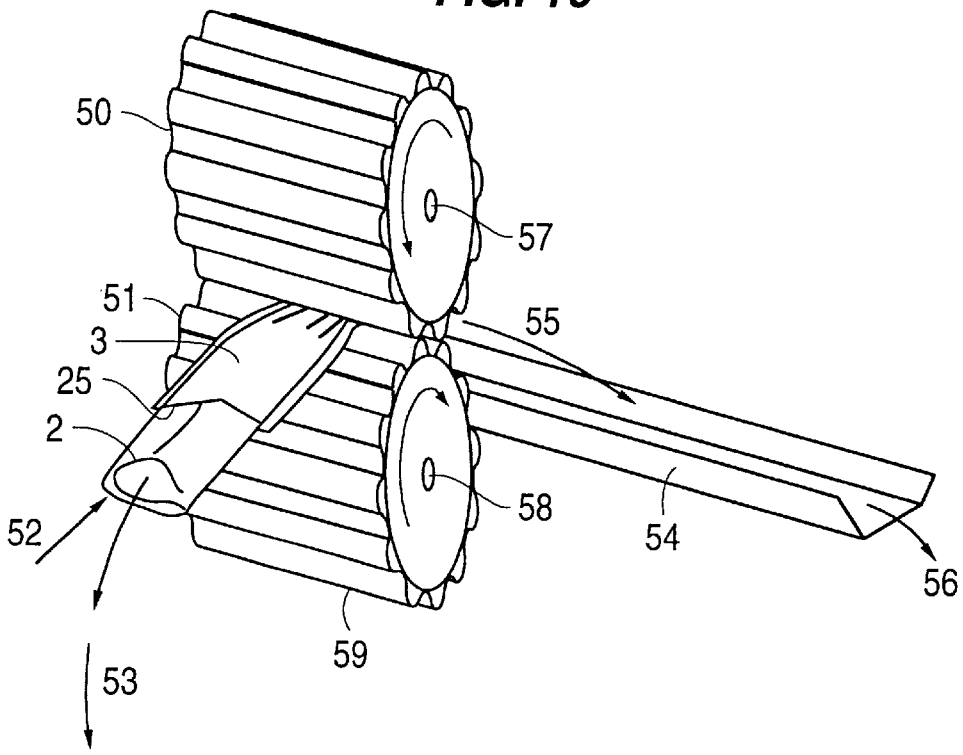
Figure 11:
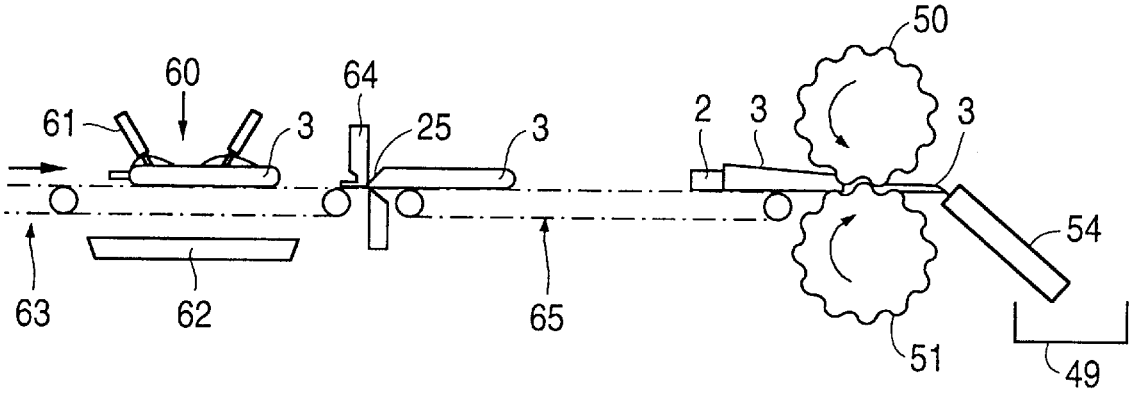

FIG. 10 shows a schematic elevational view of pressing elements in the form of roll elements for pressing a frozen plasma core out of a container, as particularly preferred at present; and FIG. 11 shows a schematic view of an apparatus with such roll-type pressing elements as well as of a preceding warming up/flushing means and a cutting open station, according to the embodiment of the invention most preferred at present, and considered as best mode.

Figure 1:
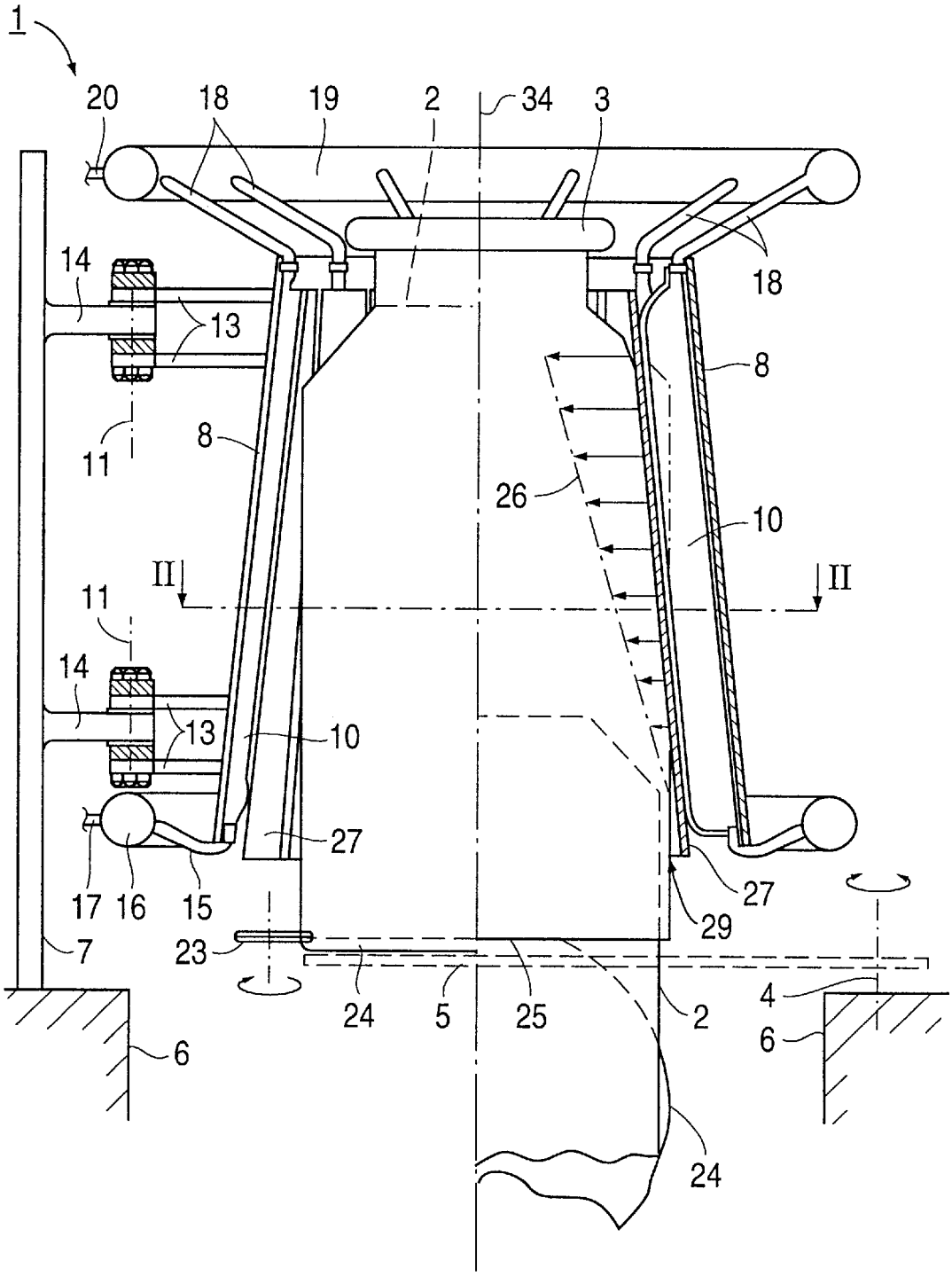
Figure 2:
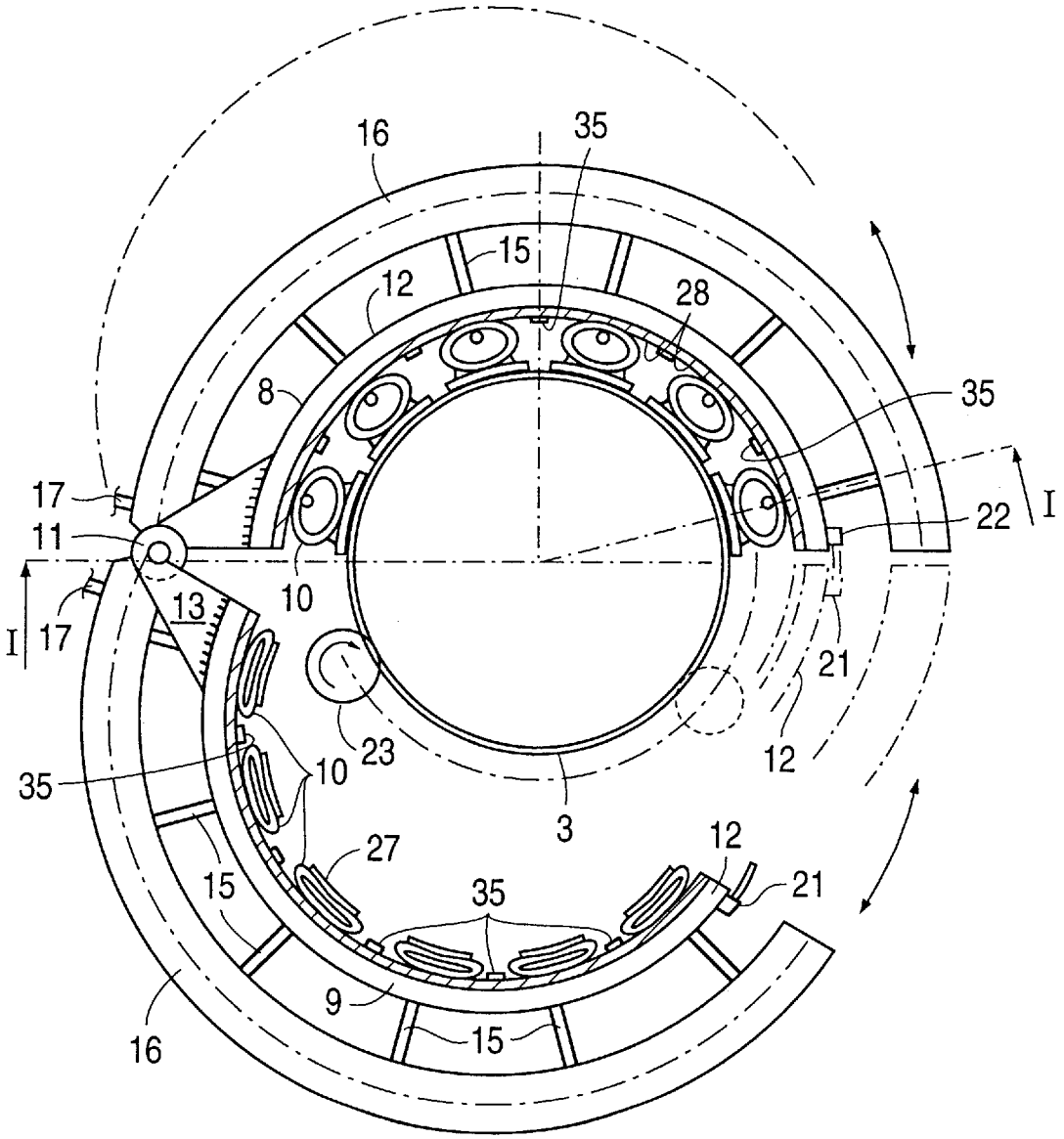

In FIG. 1, apparatus 1 for discharging a deep-frozen frozen blood plasma, i.e. a frozen plasma core 2, from a container 3 which is bottle-shaped in this instance, is schematically illustrated. To initially support the container 3, a plate-shaped support 5 capable of being laterally pivoted away about a vertical axis 4 is provided, which is pivotably mounted on a trestle 6 only quite schematically indicated, by common means not illustrated in detail. The trestle 6 comprises an upright 7 on which two carrier parts 8, 9 for hose-type pressing elements or pressing pads 10 are mounted so as to be pivotable about a vertical axis 11. For this purpose, carrier arms 13 are tightly fastened, e.g. welded, to the half-shells 12 which together defined a truncated cone, and these carrier arms 13 are hinged to brackets 14 quite schematically indicated in FIG. 1, via vertical pivots. In FIG. 2, the one upper half-shell 12 is shown in the position engaging the container 3, which is the operating position, wherein also the pressing elements 10 are illustrated in a state supplied with pressure, such as compressed air, or with a liquid medium, such as water; in FIG. 2 the other, front half-shell, i.e. the lower one in FIG. 2, is illustrated in the open position, wherein also the pressing elements 10 are shown in the still unpressurized, flat state. The pressing elements 10 consist of rubber hoses, e.g., which are connected to a manifold 16 via supply pipes 15, pressure medium, preferably warm water, being capable of being supplied to the distributing manifold 16 via a supply duct; at their upper ends, the hose-type pressing elements 10 are connected to a collecting manifold 19 via individual pipe ducts 18, from which manifold 19 the pressure medium can be conducted away via a drain duct 20. The manifolds 16 and 19, respectively, are ring ducts in the form of semicircular arcs, as is clearly visible in FIG. 2, and these ducts 16, 19 are tightly connected with the half-shells 12, e.g. via the rigid pipe ducts 15. The supply and drain ducts 17 and 20, respectively, may be hose-type ducts, which, on account of their flexibility, allow for movements of the manifolds 16, 19 together with the half-shells 12.

In the operating position, the two half-shells 12 are closed, a closing and tensioning mechanism 21, 22 being provided at the facing sides of the half-shells 12 which are diametrically opposite to the hinge with the pivot axis 11. In the closed state of the half-shells, the pressing elements 10, e.g. six (optionally, however, also more ore fewer) hose-type pressing pads per half-shell 12, are pressurized so that they come into engagement with and clamp the bottle-shaped container 3 which contains the frozen plasma core 2. At this time, also the plate-shaped support 5 below the container 3 may be pivoted away.

To discharge the frozen plasma core 2 from the container 3, the bottom side of the container 3 is opened by aid of a rotating cutting tool or blade 23, e.g. in the form of a cutting disc (cf. FIG. 1), which tool does not only rotate about its own axis, but furthermore is movable in the trestle 6 in a manner not illustrated in detail, around the container 3 so as to cut open the container 3 over approximately its entire periphery by forming a discharge opening 25, as is illustrated in the right-hand half of FIG. 1. What remains is only a narrow material web between the cut-off bottom part 24 and the remaining container 3, wherein the bottom part 24 may be downwardly pivoted about this narrow material web in film-hinge manner, whereupon the plasma core 2 is squeezed out of the container 3.

For this discharge of the frozen plasma core 2 from the container 3, the surface layer between the plasma ice core 2 and the container wall is warmed and slightly thawed, and thus a liquid film is caused between the container wall and the plasma ice core 2. To this end, before being introduced between the pressing elements 10, the container 3 including the frozen plasma core 2 is, e.g., flushed in a warming means (not illustrated in FIG. 1) with warm water having a temperature of e.g. 10° C. to 70° C., preferably 10° C. to 40° C., particularly preferred 25° C. to 40° C. Immediately thereafter, the container 3 is mounted and tightly clamped between the pressing elements 10 in the manner already described, whereupon the plate-shaped support 5 is pivoted away and the bottom part 24 is cut open. Then the pressure in the pressing elements 10 is further increased, whereby, on account of the conical shape of the half- shells 12 and the correspondingly inclined extension of the pressing elements 10, as is particularly apparent from FIG. 1, a distribution 26 of the pressure force is obtained, according to which greater pressure forces are exerted adjacent the upper side of the container 3 than in the vicinity of the bottom of the container 3, as is schematically indicated in FIG. 1. On account of this specific exertion of the pressure force, starting from the upper side of the container 3 (or generally at the side opposite the discharge opening 25), as well as particularly on account of the preceding causing of the liquid film between the container wall and the frozen plasma core 2, it is possible to gradually squeeze out the frozen plasma core 2 from top to bottom of the container 3 gently and without any problems, so that it finally falls downwardly into a receptacle not illustrated in detail. From there, the collected frozen plasma cores can be further processed in the desired manner, after having been thawed.

The described procedure at the discharge of the frozen plasma cores 2 from the containers 3 can be completely automated, and the closing of the half-shells 12 as such need not be performed by hand, by aid of the closing and bracing mechanism 21, 22, but also e.g. pneumatically or hydraulically. The pressing elements 10 may be simple hoses, they may, however, as schematically indicated at 27 in FIG. 2, be provided with additional abutment pads which enable a smooth contacting of the container wall, with the pressure being distributed. Over part of their peripheries, the pressing elements 10 may be fastened to the carrier parts 8, 9 or to the half-shells 12, respectively, simply by gluing, the half-shells 12 optionally being provided with corresponding seats for the hose-type pressing elements 10, as is indicated at 28 in FIG. 2. Even if the apparatus 1 where to be closed by hand by aid of the closing and bracing mechanism 21, 22, and not automatically, such as pneumatically, treatment of the containers 3 for squeezing out the frozen plasma cores 2, including thawing, without gripping the containers 3 by hand is possible so that contamination of the plasma is avoided. A further advantage consists in that the frozen plasma cores 2 can be discharged from the containers 3 rapidly and without any problems, particularly without any parts of the synthetic material of the containers 3 adhering to the frozen plasma cores.

As has been mentioned, in the embodiment of the apparatus according to FIGS. 1 and 2, the half-shells 12 are designed frusto-conically so as to attain the desired distribution of pressure force 26, i.e. there are circular cross-sections narrowing from bottom to top so that a frusto-conical receiving space 29 is defined for the containers 3. Such a configuration is advantageous for the bottle-shaped containers 3 described which have circular cross-section and a generally cylindrical bottle body, yet it is less suitable for other forms of containers. Therefore, advantageously the carrier parts 8, 9 are exchangeably provided on the trestle 6 or on its uprights 7, e.g. by aid of the pivots defining the pivot axis 11 on the brackets 14, so as to enable the rapid installation of other carrier equipment for other container sizes or container shapes.

Figure 3:
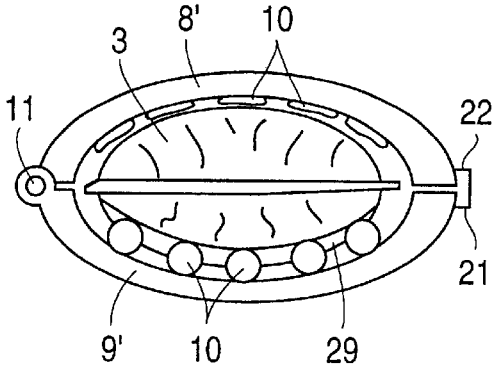
Figure 4:
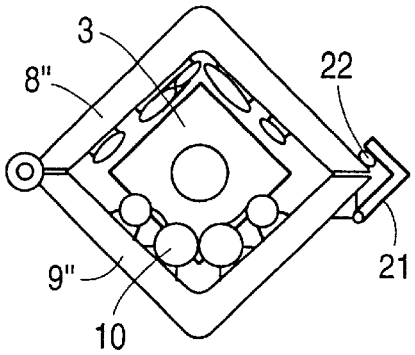

In FIGS. 3 and 4, only quite schematically a top view and a schematic cross-section, respectively, of modified carrier parts including pressing elements are shown which are useful to cooperate with other container shapes. According to FIG. 3, e.g., a receiving space 29 of oval cross-section is defined for comparatively flat, bag-type containers 3 by the shell-shaped carrier parts 8', 9'. Besides, both in FIG. 3 and also in FIG. 4, the hose-type pressing elements on the carrier part 9' are shown in the lower half of the drawing in the pressurized state, whereas in the upper half of the drawing they are illustrated in the still slack, unpressurized state.

In the embodiment according to FIG. 4, each of the carrier parts 8", 9" is angular to allow for an adaptation to bottle-shaped containers 3 of rectangular, in particular square, cross-section. There, as is illustrated in FIG. 4, also hose-type pressing elements 10 having differently sized cross-sections can be fastened to the carrier parts 8", 9".

In all the previous embodiments it would also be conceivable to use rubber-elastic, solid, elongate, generally rod-shaped pressing pads on the respective carrier parts 8, 9 or half-shells 12, respectively, instead of the hose-shaped pressing elements or pressing pads 10, and then pressure forces would have to be effected by the closing of the carrier parts 8, 9 at the discharge of the plasma cores 2 from the containers 3—particularly, as mentioned before, by pneumatic or hydraulic means, such as pneumatic closing cylinders which are sufficiently known and thus have not been illustrated in detail in the drawing.

Figure 5:
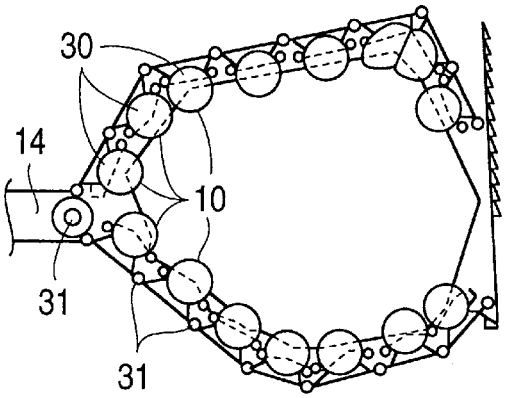
Figure 7:
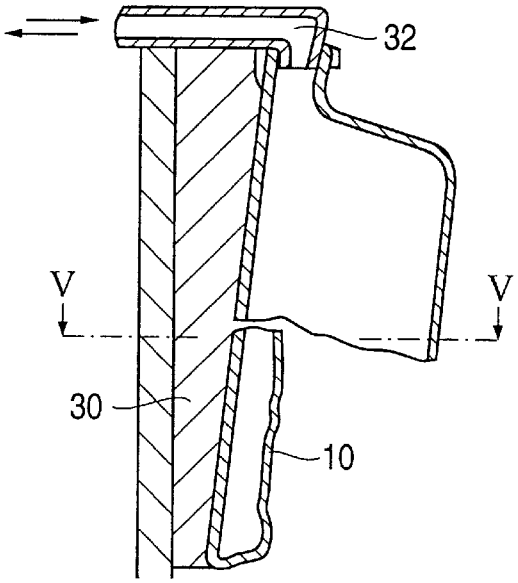
FIG. 7 shows an axial section through the ledge-shaped carrier part including the hose-type pressing element appearing in FIG. 6, in general along the line VII—VII of FIG. 6.
Figure 6:
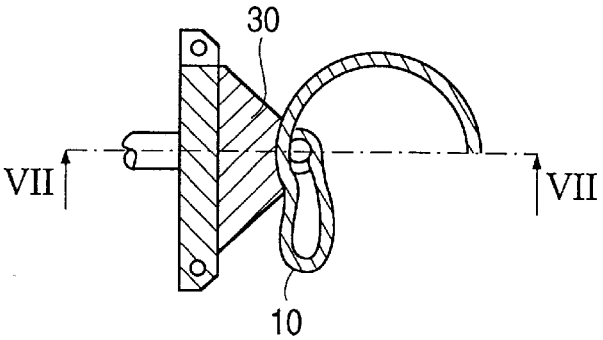
FIG. 6 shows a detail of the apparatus according to FIG. 5, in a somewhat enlarged cross-section, in general along the line VI—VI of FIG. 7.

With the embodiment according to FIGS. 5 to 7, linke-chain type articulately interconnected narrow-ledge-shaped carrier parts 30 are provided instead of two rigid half-shells 12 for adaptation to different shapes of containers. The carrier parts 30 each carry only one hose-type pressing pad 10 and are hinged to a console 14, on the one hand, and hinged to each other in pairs, on the other hand, as is indicated at 31. The ledge-shaped carrier parts 30, viewed in vertical section (cf. FIG. 7) are designed to converge from top to bottom so as to ensure for the desired inclined course for the distribution of the pressure force 26 shown in FIG. 1. According to FIG. 7, furthermore the hose-type pressing pads 10 are closed at their lower sides, and only one upper supply and drain duct 32 is provided in which the supply or drain of pressure medium is controlled by means of a selector valve not illustrated in detail.

Figure 8:
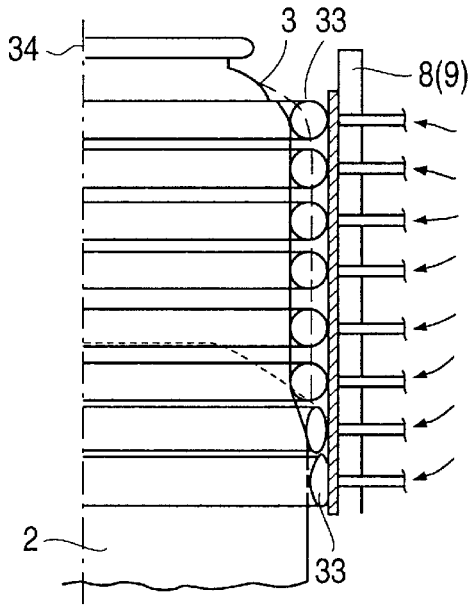
FIG. 8 shows a schematic view of one half of a modified device for discharging frozen plasma cores with annular-type, superposed hose-type pressing elements.

What is common to all the embodiments hitherto described is that as the pressing elements 10, elongate rubber-elastic pressing pads extending over the longitudinal extension of the container, in particular hose-type pressing pads capable of being pressurized with pressure medium have been provided which, starting from the container top or generally from the side opposite the discharge opening 25 of the container 3, are pressed around the outer container wall and to the later to thus discharge the deep-frozen plasma core 2 from the container 3, which plasma core is separated by the liquid film from the inner container wall and slides thereon. In FIG. 8, a variant modified with regard to the former embodiments is illustrated, in which discrete, "ring"-shaped compartments in the form of nose-type pressure pads 33 capable of being pressurized with pressure medium (such as warm water or warm air) are provided as pressing elements which are fastened to and supported on external carrier parts 8, 9 in a manner comparable to the previously described embodiments, so as to be able to exert the pressure inwardly, onto the container 3 when pressurized. The ring-shaped pressing pads 33 are capable of being separately, i.e. independently from each other, pressurized, and preferably they are pressurized one after the other, starting at the top and in temporally successive manner so as to gradually squeeze the frozen plasma core 2 out of the container 3.

For the sake of simplicity, the remaining components of the device have been omitted in FIG. 8; moreover, in the embodiment according to FIG. 8 the pressing pads 33 may each extend over half the periphery of the container 3 so as to enable opening and closing of the carrier parts 8, 9, in a similar manner as shown in FIG. 2, for laterally introducing the containers 3; however, when the containers 3 are introduced in the direction of their longitudinal axes 34, e.g. from top or, preferably, from bottom (in view of the conical arrangement of the pressing elements), the carrier parts 8, 9 including the pressing elements 10 may be provided in the form of a closed ring.

As has already been mentioned, the liquid film between the frozen plasma core 2 and the container 3 may be formed by flushing with warm water in the course of cleaning, before the containers 3 are supplied to the apparatus 1, it is, however—additionally or thereinstead—also possible to mount corresponding warming or heating elements, e.g. infrared radiators within the apparatus 1 itself, on the carrier parts 8, 9, as the warming means, as is schematically indicated at 35 in FIG. 2. These warming elements 35 may also be formed by warm water nozzles distributed over the height of the container.

Figure 9:
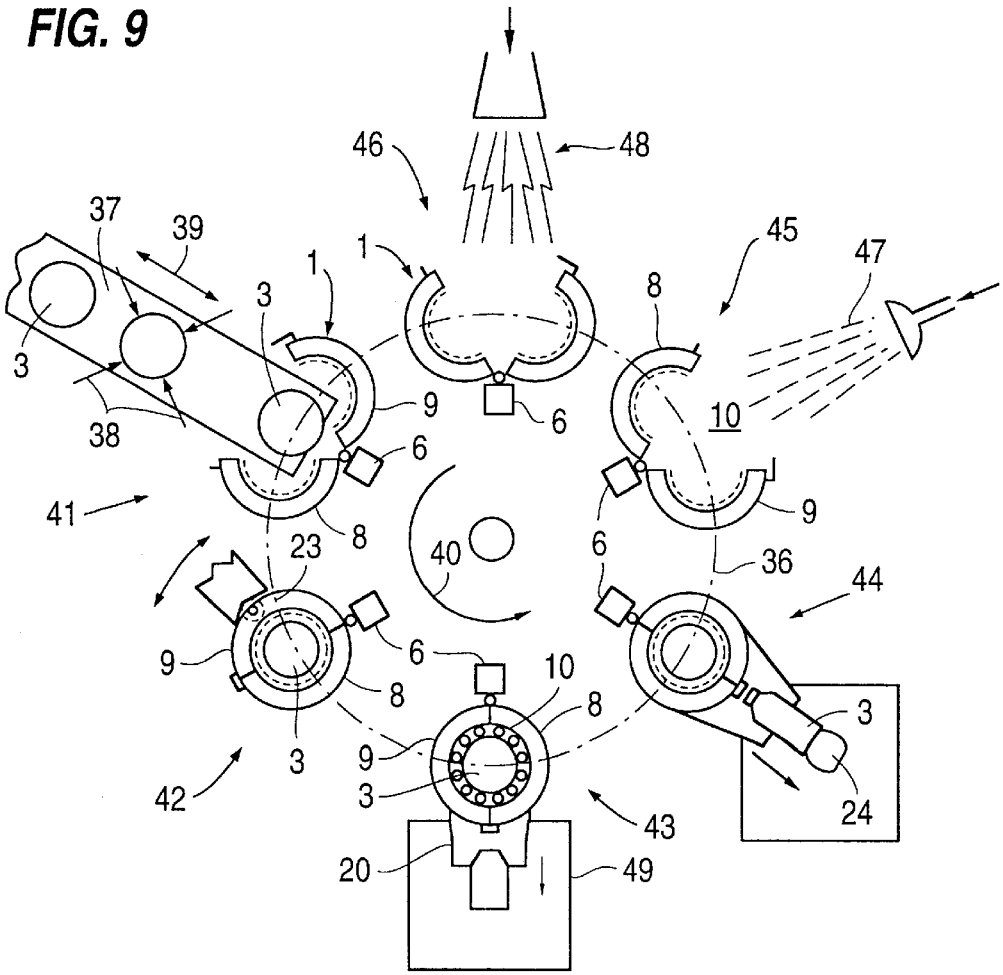
FIG. 9 shows a schematic top view onto a revolver arrangement comprising six frozen plasma core discharge apparatuses, e.g. similar to FIGS. 1 and 2, and corresponding to six working stations.

In FIG. 9, a revolver arrangement comprising several, e.g. six, apparatuses 1, as described above, is schematically illustrated, such a revolver arrangement allowing for a particularly rapid carrying out of the method for discharging the plasma cores 2 from the containers 3. In detail, a merely schematically indicated revolver 36 is provided, on which—again merely schematically indicated—trestles 6 including half-shell carrier parts 8, 9 are provided at equal angular distances (corresponding to 60° central angles). For the sake of simplicity, the pressing elements 10 mounted on these carrier parts 8, 9 and in the flat state are merely indicated by lines.

In detail, the revolver arrangement according to FIG. 9 comprises six working stations 41 to 46 according to the six apparatuses 1, wherein in the first working station 41, a container supply station, the containers 3 containing the frozen plasma cores 2 are supplied in upright position via a conventional conveyor 37, such as, e.g., a roller conveyor or a conveying belt. Before they reach the supply station 41, the containers 3 are flushed in a warming station 38 on this conveyor 37 with warm water at a temperature of from 10° C. to 70° C., preferably 10° C. to 40° C., as schematically indicated by arrows. In doing so not only are the containers 3 externally cleaned as a precaution, but also the desired liquid film between the inner container wall and the frozen plasma core 2 contained therein is caused, so that subsequently the separation of the frozen plasma core and container can take place without any problems, when squeezing out is effected by aid of the apparatuses 1.

In the container supply station 41 the respective container 3 is enclosed and tightly clamped between the carrier parts 8, 9 of the apparatus 1 located there, whereupon the preferably displaceably arranged conveyor 37 is retracted from the region of the supply station 41, of arrow 39 in FIG. 9, so as to release the lower side of the container 3. Thus, the conveyor 37 here forms the removable support for the container 3 which is active as long as the container 3 has not been clamped tight by the carrier parts 8, 9, or their pressing elements 10, respectively.

The intermittently driven revolver 36 then rotates in the direction of arrow 40, counterclock-wise according to the illustration in FIG. 9, by 60° so that the apparatus 1 with the container 3 arrives at the second station 42, a cutting station, in which a discharge opening 25 is made in the container 3 by aid of a disc-shaped cutting tool 23 moved circularly around nearly the entire periphery of the container 3 and additionally rotating about its own axis.

After a further rotation by another 60°, the next station 43 is reached in which the plasma core is pressed out of the container 3 through the discharge opening 25 thus made, as has already been explained before, in particular with reference to FIGS. 1 and 2. The pressure medium drain duct is schematically indicated at 20 in FIG. 9.

In the next station 44, the container disposal station, the empty containers 3 are removed from the apparatus, with a possible check as to whether or not the containers 3 are actually empty, which may be an optical check via a light sensor, or also by weighing on a weighing cell.

In the next station 45 the apparatus 1 which is empty and opened again is cleaned, e.g. by aid of a flushing means, as schematically indicated at 47 in FIG. 9. This may be a cleaning with hot water or steam, in which the entire apparatus 1 and particularly the parts getting into contact with the container 3 is flushed.

In the following drying station 46, the apparatus 1 is dried by hot air, as indicated at 48, whereupon, after having been returned to the first working station 41, it is again ready to receive a container 3.

Instead of such a revolver arrangement is would also be conceivable to supply the containers 3 automatically supplied by means of a conventional conveying technique, in parallel to several apparatuses 1 via common switches of diverters, each apparatus then possibly being provided with a separate collecting receptacle (49 in FIG. 9), wherein it would, however, also be possible to move a receptacle on a conveyor belt between the individual apparatuses so as to receive the frozen plasma cores; for this, the arrangements would pass the individual method steps (receiving the container, making a discharge opening, squeezing out the plasma core, removing the empty container and cleaning) in temporally sequential manner. It would also be conceivable to house the apparatus in a tub for cleaning which can be flooded with cleaning fluid.

In case of bag-type containers 3 (cf. FIG. 3) it has been shown that it suffices to cut open the container 3 over little more than one half of its periphery (slightly beyond the side walls of the container 3) to make the discharge opening 25, wherein then—on account of the relatively flat shape of the container 3—the obtained bottom part also can tilt away without any problems when the frozen plasma core is squeezed out.

In FIG. 10, an arrangement including two roll elements 50, 51 as pressing elements is schematically illustrated, a respective container 3 being gripped between them under squeezing out the contained ice core, e.g. the frozen blood plasma core 2. The still full container 3, into which a discharge opening 25 has already been cut, is inserted in the direction of arrow 52, and the ice core 2 is removed in the direction of arrows 53. At the rear side of the roll elements 50, 51, a chute 54 is provided for the transport of the empty containers 3, cf. also arrows 55, 56 in FIG. 10.

The two rolls 50, 51 are driven in counter-directions about their parallel axes 57, 58 by conventional driving means not illustrated in detail, and they may have a surface 59 configured to increase friction, e.g. in the form of ribs or flutes, so as to securely grip the container 3 and pull it through between the roll elements 50, 51. The roll elements 50, 51 may be of special steel or of a suitable, solid, optionally fibre-reinforce, synthetic material. It would also be conceivable to provide several consecutively arranged pairs of rolls and to pull through the respective container between the rolls thereof while squeezing out possible ice core residues.

In FIG. 11, an apparatus comprising such roll-type pressing elements 50, 51 according to FIG. 10 is schematically illustrated; before the containers 3—still with the ice core—are supplied to the roll elements 50, 51, they are flushed by aid of flushing nozzles 61 in a warming means 60 which simultaneously constitutes a cleaning or flushing means, with warm water of e.g. 25° C. to 40° C., or with a correspondingly warm cleaning liquid, the flushing liquid used then being collected in a collecting tub 62. The containers 3 with the plasma products may automatically be supplied, e.g. by aid of a conveyor 63 schematically indicated as conveying belt or as a roller conveyor, and after having passed the warming means 60 they get to a cutting station 64 only schematically indicated by blades, the discharge opening 25 here being made on the container 3, i.e. at its trailing end in conveying direction. (In principle, the discharge opening 25 may be made by partially cutting open the container 3—as previously explained by way of FIG. 1). The container 3 with the frozen plasma product then gets directly to the roll elements 50, 51, e.g. on a further conveying belt or roller conveyor 65, where, as a consequence of previous warming at 60, and of the liquid film formed thereby between the container 3 and the ice core 2, a squeezing out of the latter can be performed gently and without any problems and practically entirely.

The pressed out ice core 2 may then automatically be moved by aid of a transversely movable ram not illustrated into an ice core collecting receptacle also not illustrated. Via the chute 54 the empty containers 3 reach a receptacle 49 also only schematically shown.

Tests have shown that when using warm water or washing liquid having a temperature of from 25° C. to 40° C. a suitable liquid film, depending on the type and thickness of the container 3 and the size of the product, can be reached after several 10 seconds up to one minute; for instance, the time for slightly thawing takes from ½ minute to 1 minute.

What is claimed is:

1. A method of discharging a frozen blood product from a container, comprising:

providing a container having a wall and containing a frozen blood product, said frozen blood product having a surface layer contacting said container wall;

externally warming said container wall to thaw said surface layer of said frozen blood product so as to form a liquid film between the remaining frozen blood product and said container wall;

providing a discharge opening end on one side of said container;

applying pressure forces on said container wall and on said frozen blood product starting from a side opposite said discharge opening end so as to squeeze said frozen blood product out of said container through said discharge opening, wherein the discharge opening is provided at said end of said container by cutting open said container end over only a part of the periphery of the container, but at least more than half the periphery of the container, thereby leaving a remaining portion connecting the cut off end with the remainder of the container.

2. A method as set forth in claim 1, wherein said external warming is effected by an external flushing of said container with a warmed medium.

3. A method as set forth in claim 2, wherein said warmed medium is at least one of warm water and warm air.

4. A method as set forth in claim 2, wherein said warmed medium is maintained at a temperature of between approximately 10° C. and 70° C.

5. A method as set forth in claim 4, wherein said warmed medium is maintained at a temperature of between 10° C. and 40° C.

6. A method as set forth in claim 4, wherein said warmed medium is maintained at a temperature of between 25° C. and 40° C.

7. A method as set forth in claim 1, wherein said external warming is effected by infrared radiation.

8. A method as set forth in claim 1, wherein said discharge opening is provided by cutting open said container end by aid of a rotating cutting tool.

9. A method as set forth in claim 1, wherein said container has a longitudinal extension and said pressure forces are distributed on said container wall over the longitudinal extension of said container in a manner that the pressure forces decrease from the side opposite said discharge opening towards said discharge opening.

10. A method as set forth in claim 1, wherein said pressure forces are applied by means of pressing elements lengthwise inclinedly applied to the container over the longitudinal extension of said container.

11. A method as set forth in claim 1, wherein said pressure forces are applied by a temporally successive pressing on of pressing elements distributed over the longitudinal extension of said container, starting from said side opposite said discharge opening.

12. A method as set forth in claim 1, wherein said pressure forces are applied by roll elements.

13. A method as set forth in claim 1, wherein said container is cleaned by external flushing with a cleaning medium before said frozen blood product is discharged from said container.

14. An apparatus for discharging a frozen blood product from a container having a container wall, wherein said apparatus comprises warming means for externally thawing said frozen blood product in said container, thereby forming a liquid surface layer of said frozen blood product on said container wall;

means for providing a discharge opening on one side of said container, wherein said means for providing a discharge opening comprises means for partly cutting off said end of said container at least more than half the periphery of the container, thereby leaving a remaining portion connecting the cut off end with the remainder of the container; and pressing elements for squeezing the frozen blood product out of the container through said discharge opening.

15. An apparatus as set forth in claim 14, further comprising a trestle for accommodating said pressing elements thereon, said pressing elements at least including a rigid part and being associated with a receiving space for said container containing said blood product, and pressing means to be actuated for putting said pressing elements to a container received in said receiving space under exertion of pressure forces, said exertion of pressure forces starting at a side of the container opposite said discharge opening.

16. An apparatus as set forth in claim 15, wherein said rigid part is a part of said pressing elements.

17. An apparatus as set forth in claim 15, wherein said rigid part is a rigid carrier part.

18. An apparatus as set forth in claim 15, wherein said pressing elements are exchangeably mounted to said trestle for adapting to different container sizes.

19. An apparatus as set forth in claim 17, wherein said pressing elements inclusive of said carrier parts are exchangeably mounted to said trestle for adapting to different container sizes.

20. An apparatus as set forth in claim 15, wherein said container has a longitudinal extension and said pressing elements generally extend over the longitudinal extension of said container and are inclinedly placeable against said container.

21. An apparatus as set forth in claim 17, wherein said carrier parts comprise two half-shells arranged according to a conical surface.

22. An apparatus according to claim 21, wherein said half-shells each have first and second longitudinal sides, and wherein said pressing means to be actuated for attaching said pressing elements include means articulately interconnecting said half-shells at said first longitudinal sides thereof, and a closing and bracing mechanism provided at the second longitudinal sides of the half-shells to enable an exertion of generally radial pressure forces on said container.

23. An apparatus as set forth in claim 22, wherein said pressing elements are elongate, flexible pressing elements and each one of said half-shells internally carries a plurality of said elongate, flexible pressing elements.

24. An apparatus as set forth in claim 17, wherein said carrier parts are generally ledge-shaped and articulately interconnected in link-chain manner, said pressing means comprising bracing or closing means provided on a longitudinal side of said ledge-shaped carrier parts for an exertion of generally radial pressure forces on said container.

25. An apparatus as set forth in claim 24, wherein said carrier parts have an arcuate profile.

26. An apparatus as set forth in claim 24, wherein said pressing elements are flexible pressing elements, each ledge-shaped carrier part internally carrying one of said flexible pressing elements.

27. An apparatus as set forth in claim 15, wherein said pressing elements are formed by rubber-elastic pressing pads.

28. An apparatus as set forth in claim 27, wherein said rubber-elastic pressing pads are elongate.

29. An apparatus as set forth in claim 15, wherein said pressing elements are formed by pressing pads capable of being pressurized with pressure medium.

30. An apparatus as set forth in claim 29, wherein said pressing pads are hose-shaped.

31. An apparatus as set forth in claim 27, wherein said pressing pads are peripherally extending annular pressing pads.

32. An apparatus as set forth in claim 29, wherein said pressing pads capable of being pressurized with pressure medium are peripherally extending annular pressing pads.

33. An apparatus as set forth in claim 29, wherein said pressure pads are capable of being separately pressurized with pressure medium, distributed over the longitudinal extension of said container.

34. An apparatus as set forth in claim 32, wherein said pressure pads are capable of being separately pressurized with pressure medium, distributed over the longitudinal extension of said container.

35. An apparatus as set forth in claim 15, further comprising a support for said container, said support being mounted to said trestle, below said receiving space between said pressing elements and being capable of being laterally or downwardly moved away.

36. An apparatus as set forth in claim 35, wherein said support is plate-shaped.

37. An apparatus as set forth in claim 15, further comprising a cutting tool mounted on said trestle below said pressing elements and capable of being moved over more than half the periphery of said container.

38. An apparatus as set forth in claim 37, wherein said cutting tool is a cutting disc.

39. An apparatus as set forth in claim 15, further comprising sensing means for sensing a discharged, downwardly frozen dropping blood product.

40. An apparatus as set forth in claim 39, wherein said sensing means is a photoelectric switch.

41. An apparatus as set forth in claim 39, wherein said sensing means is a weighing device.

42. An apparatus as set forth in claim 15, further comprising an immersion tub capable of being flooded for cleaning purposes, said trestle including said pressing elements being mounted in said immersion tub.

43. An apparatus as set forth in claim 15, further comprising a revolver capable of being rotated about a vertical axis and including a container supply station, a frozen blood product squeeze-out station and a container disposal station, said trestle with said pressing elements being mounted on said revolver.

44. An apparatus as set forth in claim 14, wherein said pressing elements comprise at least two roll elements having generally parallel axes of rotation and capable of being rotated in opposite directions, said container being gripped at an end opposite said discharge opening and being passed in its emptied state between said at least two roll elements as said frozen blood product is squeezed out of said container.

45. An apparatus as set forth in claim 44, further comprising a chute arranged behind said roll elements so as to move away said emptied containers.

46. An apparatus as set forth in claim 14, wherein said warming means for externally thawing said frozen blood product in said container is a flushing means for externally flushing said container.

47. An apparatus as set forth in claim 46, wherein said flushing means further comprises spraying nozzles.

48. An apparatus as set forth in claim 14, wherein said warming means for externally thawing said frozen blood product in said container are infrared radiators.

* * * * *

UNITED STATES PATENT AND TRADEMARK OFFICE

CERTIFICATE OF CORRECTION

PATENT NO. : 5,829,634

DATED : November 3, 1998

INVENTOR(S) : Rudolf GLOGER et al.

It is certified that error appears in the above-identified patent and that said Letters Patent is hereby corrected as shown below:

On the title page: Foreign Application Priority Data is incorrect. Please delete [[AU] AUSTRALIA] and insert --[AT] AUSTRIA]--.

Signed and Sealed this

Ninth Day of March, 1999

*Attest:*

*Attesting Officer*

Q. TODD DICKINSON

*Acting Commissioner of Patents and Trademarks*